US006289610B1

(12) United States Patent
Girard et al.

(10) Patent No.: US 6,289,610 B1
(45) Date of Patent: Sep. 18, 2001

(54) SOLE FOR A SPORT BOOT AND A SPORT BOOT INCLUDING SUCH SOLE

(75) Inventors: Francois Girard, Veyrier du Lac; Eric Girault; Jean-Francois Paris, both of Sevrier, all of (FR)

(73) Assignee: Salomon S.A., Metz-Tessy (FR)

( * ) Notice: Subject to any disclaimer, the term of this patent is extended or adjusted under 35 U.S.C. 154(b) by 0 days.

(21) Appl. No.: 09/179,956

(22) Filed: Oct. 28, 1998

(30) Foreign Application Priority Data

Oct. 29, 1997 (FR) ..... 97.13748
Jun. 10, 1998 (FR) ..... 98.07541

(51) Int. Cl.[7] ..... A43B 5/04
(52) U.S. Cl. ..... 36/117.2; 36/117.3; 36/131
(58) Field of Search ..... 36/117.2, 117.3, 36/131

(56) References Cited

U.S. PATENT DOCUMENTS 589,443 * 9/1897 Rathbun .
4,330,949 * 5/1982 Kubelka et al. .
4,334,367 6/1982 Salamon .
4,872,272 10/1989 Wittmann et al. .
4,907,353 3/1990 Wittmann et al. .
4,930,233 6/1990 Provence .
4,945,658 * 8/1990 Provence .

FOREIGN PATENT DOCUMENTS

4229039 * 4/1993 (DE) .
740908 * 11/1996 (EP) .
2533421 3/1984 (FR) .
2645038 10/1990 (FR) .
2739788 4/1997 (FR) .
85005557 * 12/1985 (WO) .
WO87/06802 11/1987 (WO) .
WO88/05271 7/1988 (WO) .

* cited by examiner

*Primary Examiner*—Ted Kavanaugh
(74) *Attorney, Agent, or Firm*—Greenblum & Bernstein, P.L.C.

(57) ABSTRACT

A sport boot sole having at least one arrangement for connecting the boot to a sport article along an axis substantially transverse to the longitudinal axis of the boot, this connecting arrangement having an anchoring device in the sole, wherein the anchoring device is arranged along a plane essentially perpendicular to the longitudinal axis of the sole and is independent. Advantageously, each connecting arrangement is constituted by a substantially U-shaped buckle having a transverse arm defining the articulation axle and two lateral arms, and each lateral arm is anchored along a substantially vertical direction inside the sole.

33 Claims, 4 Drawing Sheets

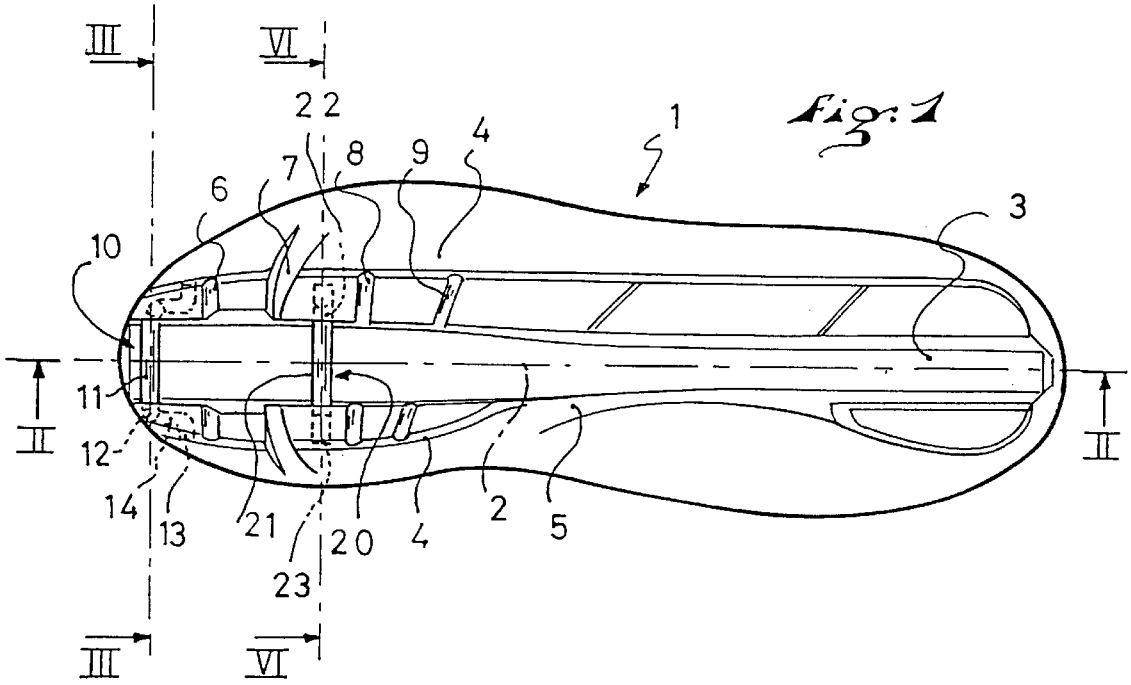
Fig: 1
Fig: 2
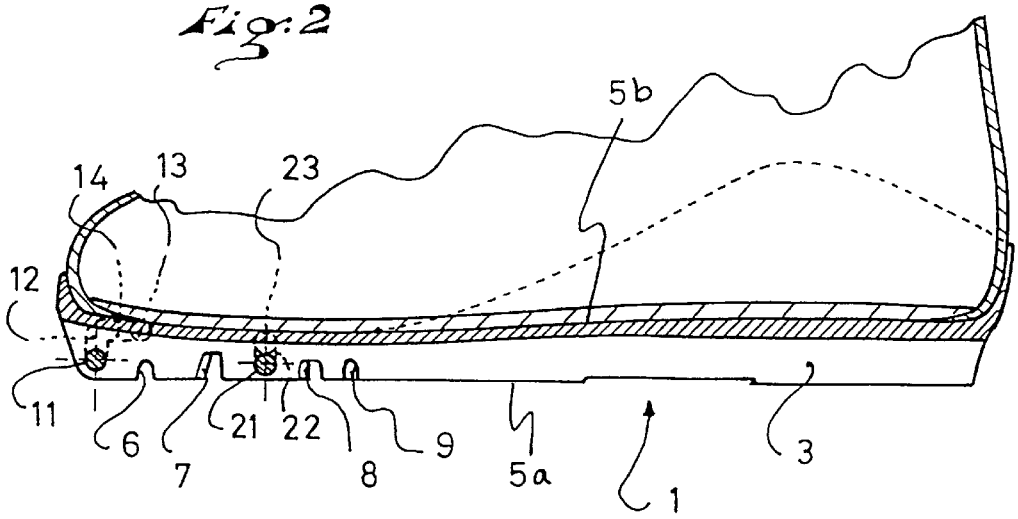

Fig: 3
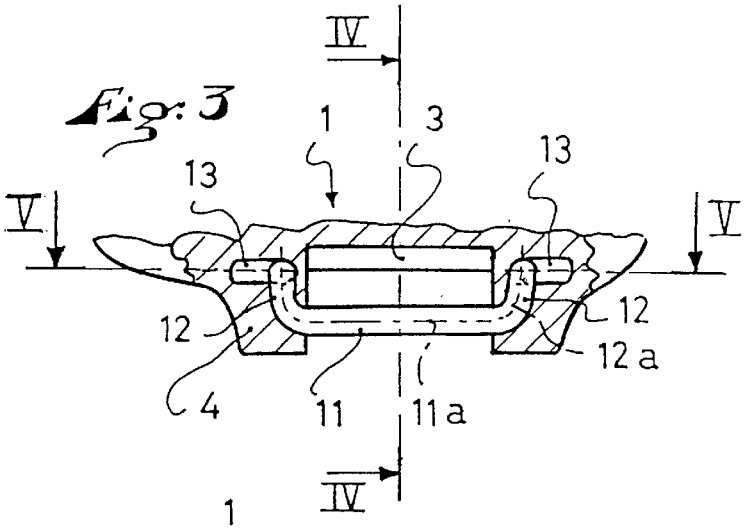
Fig: 4
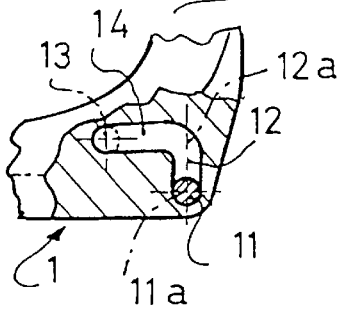
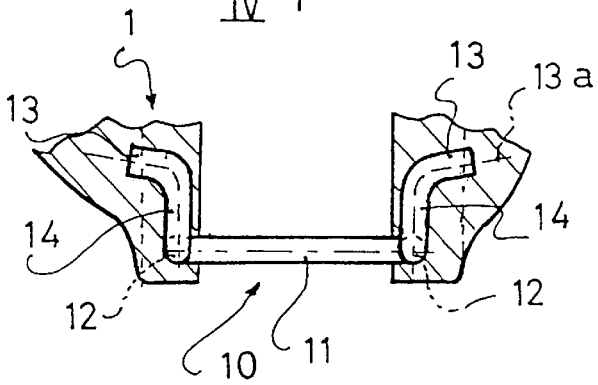
Fig: 5
Fig: 6
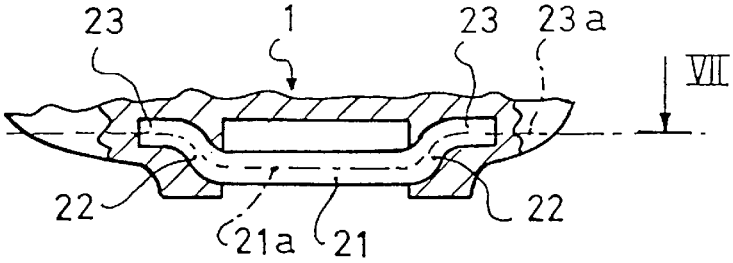
Fig: 7
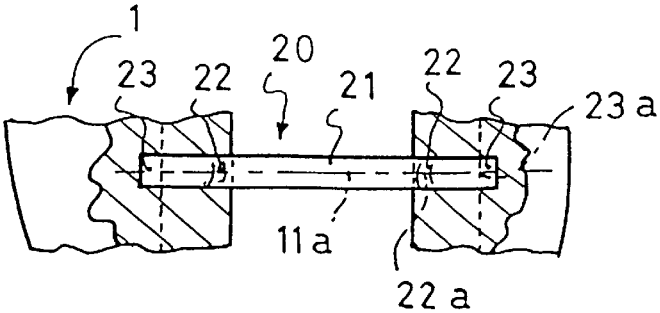

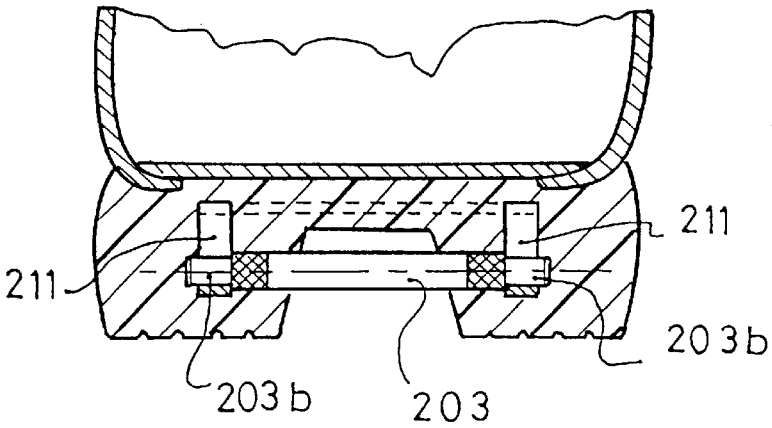
Fig: 12
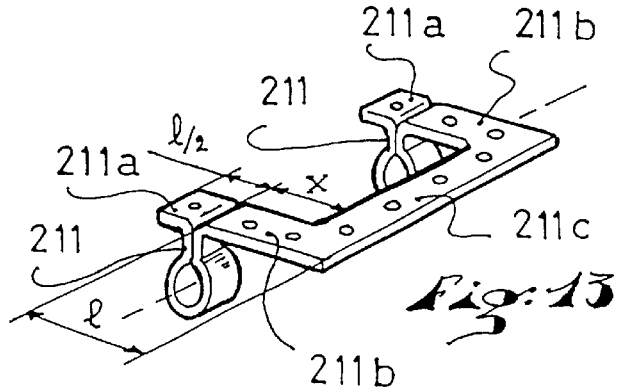
Fig: 13
Fig: 14
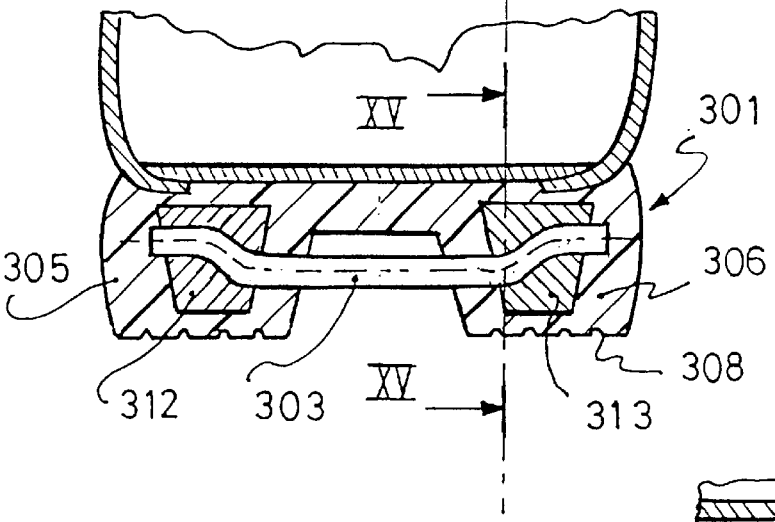
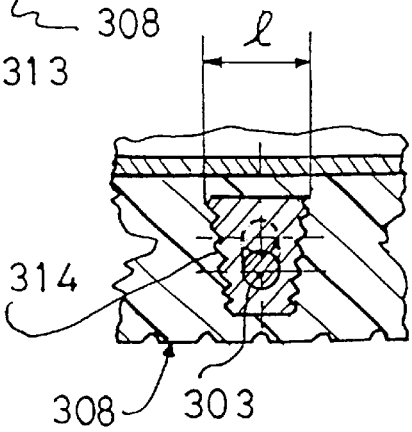
Fig: 15

SOLE FOR A SPORT BOOT AND A SPORT BOOT INCLUDING SUCH SOLE

BACKGROUND OF THE INVENTION

1. Field of the Invention

The present invention relates to sport boots, especially gliding sports, such as cross-country skiing or skating, or other sports, such as biking, in which the boot must be attached to the sport article while preserving a possibility of foot movement during the practice of the sport, or is independent thereof, for example, when walking.

2. Description of the Background and Material Information

In the aforementioned sports, and especially in cross-country skiing, various methods of fastening the boot to the sport article have been investigated.

Thus, the conventional binding method consists in attaching the boot to the cross-country ski by means of a stirrup cooperating with a front overlapping part of the sole and pressing this part against the cross-country ski.

Such a binding method prevents the complete movement of the foot since the foot is attached to an entire front part. To overcome this drawback, various systems have been proposed to articulate the boot on the cross-country ski around an axle attached transversely to the boot.

Different positions and anchoring methods of this axle at the front of the boot, at the level of the metatarsal zones, by means of inserts, etc., have been tested with a more or less degree of satisfaction.

The problem, in fact, is that a compromise must be found between two completely contradictory requirements, namely:

- a maximum movement of the foot, necessary for obtaining a substantial impulse or a wide stride, depending on the sport practiced;
- an optimum control and steering of the gliding member or sport article which, in theory, can only be obtained through a permanent "contact" between the foot and the former, and therefore it is not compatible with a movement of the foot;
- a sufficient anchoring of the insert or of the articulation axle in the sole so as to keep the axle or insert from being pulled out when practicing the sport.

This problem was partially resolved in the document FR 2 739 788, which provides an assembly of a boot and a device for binding a boot to a sport article, in which the boot has two anchoring means constituted by transverse axles arranged, one at the front of the boot, and the other substantially in the area of the metatarsophalangeal articulation zone, and in which the binding device is provided so as to allow the rotation of the boot around the first anchoring axle and to exert a constant elastic return on the second anchoring axle in the direction of the sport article.

Thus, providing means for the elastic return of the boot towards the sport article, not at the front of the boot as in currently known devices, but at the rear of the binding means of the boot, allows controlling the boot with respect to the gliding member even when the boot is raised.

Such a boot/binding system therefore allows reconciling the problems of raising and control/steering of the boot with respect to the sport article, and therefore allows, in principle, an optimum movement of the foot.

However, such a movement of the foot, especially during the final pivoting phase around the metatarsophalangeal articulation, can only be obtained with a boot that is particularly flexible in the entire front zone of the boot.

Such a requirement for flexibility is difficult to reconcile with an anchoring of rotational axles, connecting means, or inserts arranged specifically in this zone.

Indeed, the anchoring techniques known, for example, in documents FR 2 533 421, WO 88/05271, and FR 2 645 038, all use an insert, whether of hard plastic or metallic materials, extending along a substantially horizontal plane in the longitudinal direction of the sole and stiffening the latter proportionately.

In the case of U.S. Pat. No. 4,872,272, the articulation axle is constituted by the transverse arm of a U-shaped buckle, whose lateral arms also extend deeply inside the sole in the longitudinal direction and therefore prevent any flexion at the level of the lateral arms. The constraint of a correct anchoring of the insert or rotational axle is greater especially as the material constituting the sole is soft, and the forces exerted on the insert or axle during the practice of the sport are substantial.

SUMMARY OF THE INVENTION

An object of the present invention is to overcome the aforementioned drawbacks and to propose a construction of the sole allowing to maintain a maximum of flexibility in the front zone thereof while enabling the desired anchoring of the articulation axle or axles or any other connecting means, even when the sole is made of a relatively soft material.

This object is obtained in the sole according to the invention which is of the type having at least one transverse connecting means, in that each connecting means has anchoring means inside the sole which are arranged along a plane essentially perpendicular to the longitudinal axis of the sole.

Thus, the anchoring occurs essentially in a vertical plane of the boot, and not in a plane essentially horizontal thereto, which allows guaranteeing a possibility of flexion of the sole over a greater length, on both sides of each anchoring point, and therefore increasing the general flexibility of the sole without decreasing the anchoring capability.

In the case where two or more connecting means are provided, the anchorings for each connecting means are independent, which allows guaranteeing a possibility of flexion of the sole between two successive connecting means.

Also advantageously, an essentially vertically oriented cutout is associated with each connecting means, so as to guarantee a possibility of flexion of the sole immediately at the rear and/or at the front of the axle.

BRIEF DESCRIPTION OF DRAWINGS

In any case, the invention will be better understood and other characteristics thereof will become obvious with the following description and the annexed drawings, provided as non-limiting to the invention, wherein:

FIG. 1 is a bottom view of a sole according to the invention;

FIG. 2 is a longitudinal cross sectional view taken along the line II—II of FIG. 1;

FIG. 3 is a cross sectional view taken along the line III—III of FIG. 1;

FIG. 4 is a cross sectional view taken along the line IV—IV of FIG. 3;

FIG. 5 is a cross sectional view taken along the line V—V of FIG. 3;

FIG. 6 is a cross sectional view taken along the line VI—VI of FIG 1.

FIG. 7 is a cross sectional view taken along the line VII—VII of FIG. 6;

FIG. 12 is a cross sectional view taken along the line XII—XII of FIG. 11;

FIG. 13 is a perspective view of the insert of FIGS. 11 and 12;

FIG. 14 is a view similar to FIG. 12 of an anchoring according to another embodiment; and FIG. 15 is a cross sectional view taken along the line XV—XV of FIG. 14.

DETAILED DESCRIPTION OF THE INVENTION

Figure 8:
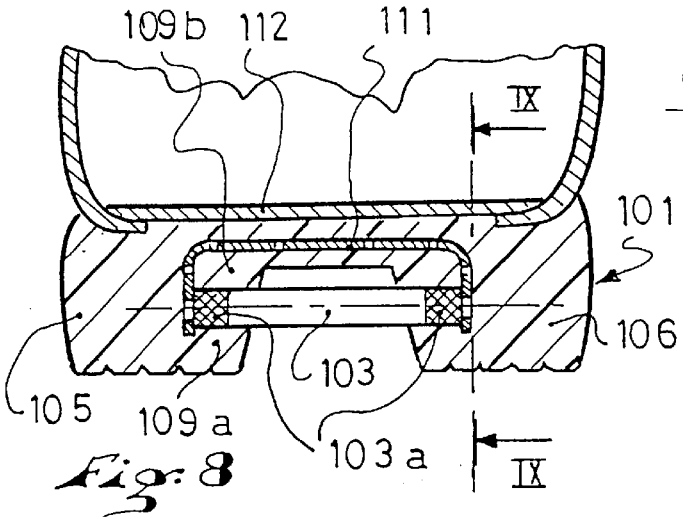
FIG. 8 is a cross sectional view similar to FIG. 3 of an anchoring according to another embodiment.

As shown more particularly in FIGS. 1 and 2, the sole 1 according to this embodiment of the invention has a guiding groove 3 having a progressive transverse section arranged along the longitudinal axis or vertical median plane 2 of the sole, which receives two connecting axles, respectively, front 10 and rear 20, anchored independently one from the other. Any form of the transverse section of the groove 3 is contemplated according to the invention.

The first connecting axle 10 is arranged substantially in the area of the front end portion of the sole, whereas the second connecting axle 20 is arranged further to the rear, substantially in the area of the metatarsophalangeal articulation zone or in front thereof.

The guiding groove 3 is bordered laterally by two flanges 4 having a substantially rectangular section, that project downwardly from the bottom 5 of the sole which also defines the bottom of the groove 3. As shown in FIG. 2, the sole 1 includes a bottom or walking surface 5*a* and an upper surface 5*b*.

Flexion slots, 6, 7, 8, 9, respectively, are provided in the flanges 4 at the rear and/or at the front of each connecting axle 10, 20, as explained below.

As FIGS. 3–7 show more specifically, each connecting axle 10, 20 is constituted by a substantially U-shaped buckle having a transverse arm 11, 21, constituting a connecting member or means and two lateral arms 12, 22, extending substantially perpendicularly to the transverse arm 11, 21. Each lateral arm 12, 22 is anchored in one of the lateral flanges 4 of the guiding groove 3 (see FIGS. 3 and 6) and, thereby, constitute at least part of an anchoring member or means.

Each transverse arm 11, 21 therefore extends inside the guiding groove 3 along a transverse horizontal direction perpendicular to the longitudinal axis or plane of the sole.

Likewise, each lateral arm 12, 22 extends along an essentially vertical plane of the sole. As FIGS. 4 and 7 show in particular, the transverse axes 11*a*, 21*a* of each transverse arm 11, 21 is contained in the same vertical plane as the transverse axes 12*a*, 22*a*, of the lateral arms 12, 22, respectively.

Thus, the anchored lateral arms 12, 22 of each axle 10, 20 are arranged along a plane essentially perpendicular to the longitudinal axis of the sole.

Furthermore, each lateral arm 12, 22 is provided with an end portion 13, 23, bent along a direction 13*a*, 23*a*, substantially horizontal and parallel to the transverse arm 11, 21 of each connecting means.

In the case of the connecting axle 20, the longitudinal axes 22*a*, 23*a* of each lateral arm 22 and of its bent end portion 23 are contained in the same vertical plane as the longitudinal axis 21*a* of the transverse arm 21 (see FIG. 7).

Thus, the axle 21 and its anchoring means 22, 23 are essentially contained in a same vertical plane of the sole and have no extension in the longitudinal direction of the sole, with the exception of the thickness of the buckle itself. Such an anchoring reduces the interferences with the flexion of the sole to the minimum.

In the case of the axle 11, on which the maximum of the connecting forces are exerted, the bent end portions 13 are connected to the associated lateral arms 12 by a substantially horizontal part 14, extending along the longitudinal axis of the sole.

Such a construction allows optimizing the anchoring while limiting the extension of the arms 12, 13, 14 in the longitudinal direction of the axle to the minimum.

Thus, in both cases, a possibility of maximum flexion of the sole is preserved. This possibility of flexion is further optimized in that the axles 10, 20 are anchored separately.

Finally, the flexion slots 6, 7, 8, 9 are associated to each connecting axle 10, 20 and also allow optimizing flexion.

The slot 6 is a transverse slot arranged just behind the bent end portions 13 of the anchoring arms of the axle 10.

The slot 7 is also a transverse slot arranged just in front of the connecting axle 20.

Finally, the slots 8, 9 are also substantially transverse slots arranged behind the connecting axle 20.

Furthermore, the slot 9 is slightly angled with respect to the longitudinal axis 3 of the boot, and along a direction corresponding substantially to the metatarsophalangeal articulation.

In any case, the slots 6, 7, 8, 9 extend on both sides over the whole width of the lateral flanges 4.

As can be easily understood, the association of axles 10, 20 anchored essentially vertically and of transverse slots 6, 7, 8, 9 allows guaranteeing a maximum flexion of the sole.

Figure 9:
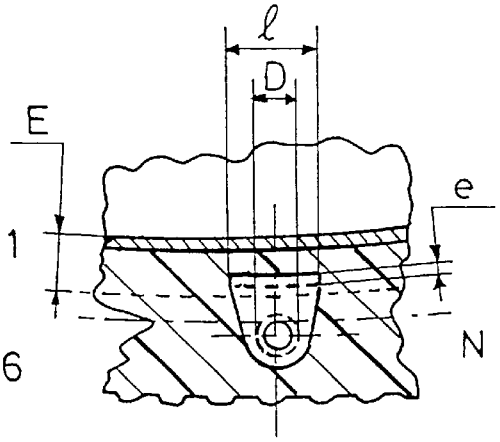
FIG. 9 is a cross sectional view taken along the line IX—IX of FIG. 8.
Figure 10:
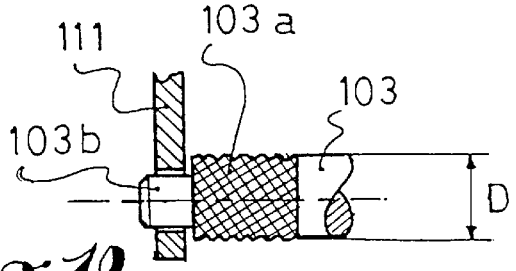
FIG. 10 is an enlarged detailed view of FIG. 8.

FIGS. 8–10 show, in a cross section, a second embodiment of the invention adapted to allow an anchoring in a thickness E of the sole, which is made of a particularly flexible material, such as natural rubber or crepe, and applicable for any of the anchoring means.

The connecting means 103 is, for cost-related reasons, preferably rectilinear. Its cross section is circular and about 4 mm in diameter in the embodiment shown, but the section could be different. Towards its end portions, there is a knurl 103*a* for improving its anchoring into the lateral edges 105 and 106 of the sole 101, then a shoulder 103*b*. These shouldered parts will receive the generally U-shaped supplemental anchoring means 111. The assembly of this anchoring means onto the connecting means 103–103*b* will be carried out by deformation of the U-shape of the anchoring means 111.

Preferably made of thin sheet metal, this anchoring means 111 has, at least in its horizontal part, a section with the dimension "l×e" (see FIG. 9) capable of fulfilling two functions: due to the width "l," ensuring a good contact surface with the material of the sole 101 to work a substantial mass 109*a*, 109*b* of the sole 101, and due to its width "e," ensuring a thickness sufficiently low to be correctly embedded into the relatively small thickness E of the sole.

Thus, even when constituted of a soft material and adapted for walking, the sole 101 can withstand the stresses of the sport boot/sport apparatus linkage and ensure a solid nesting for the connecting means 103.

Preferably, the width "l" of the anchoring means is small, and this part is located at the level of or above the neutral fiber N of the sole, therefore in a neutral zone or compression zone when it bends, so as not to adversely affect the longitudinal flexibility of the sole.

Finally, this dimension "l" is also greater than the diameter D of the connecting means 103 so as to allow a positioning and an easy holding of the connecting means/anchoring means assembly in the mold of the sole for molding, and to allow increasing the contact surface and therefore improving the anchoring.

In this regard, it must be noted that if the sole 101 must be molded to a boot upper already having an insole 112, the anchoring means 111 can be advantageously attached beforehand to this insole 112 by rivets or other equivalent means so as to improve the anchoring even further.

Figure 11:
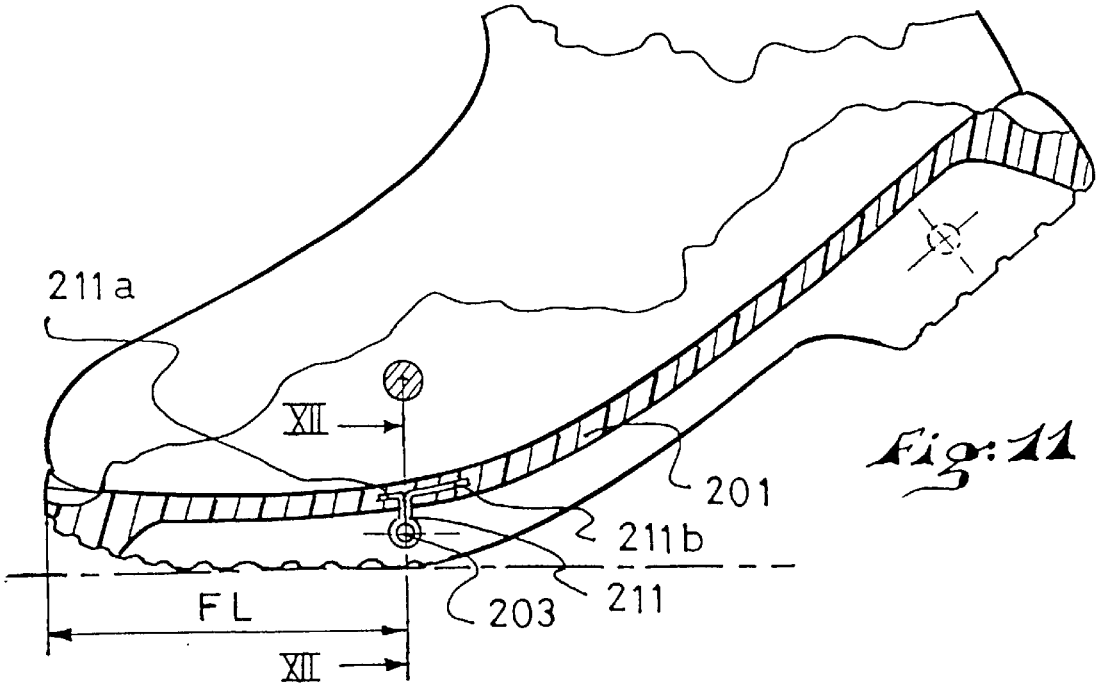
FIG. 11 is a longitudinal cross sectional view of a boot equipped with inserts according to another anchoring embodiment.

FIGS. 11, 12, 13 show a third embodiment of the anchoring means. This means 211 is bent in the shape of a "hook" to surround the end portions 203*b* of the connecting means 203. It extends in an essentially vertical plane in the thickness of the sole 201 to end in tabs 211*a*, 211*b*. The tabs 211*a* will be oriented preferably towards the tip of the sole and will be short (l/2) so as not to significantly alter the flexibility of the sole 201. The tabs 211*b* will be connected by a blade 211*c* so as to obtain a manipulable block that is capable of being easily positioned and maintained in the injection mold of the sole 201.

This blade 211*c*, preferably, will not have a longitudinal grip in the sole higher than the tabs 211*a*. In this case, the dimension X will be close to zero.

However, the sole 201 must particularly bend over a distance FL shown in FIG. 11, corresponding substantially to the distance between the toes and the metatarsal bones. If the connecting means 203 is placed at the level of the forefoot articulation or behind, the sole flexibility becomes less effective behind this connecting means 203 and the dimension X can be more substantial to manage a type of energizing of this forefoot flexion.

FIGS. 14 and 15 show a fourth embodiment of the anchoring means associated with the connecting means.

In this case, the connecting means 303 is preferably angled so that its end portions embedded in the zones 305 and 306 of the sole 301 are spaced from the bottom or walking surface 308 of the sole.

Before it is molded into the sole 301, parts 312, 313, preferably of the same material as the sole but of a higher modulus and hardness, are molded to the end portions of this connecting means.

These parts, with a reduced width "l" (see FIG. 15), to be compatible with a good longitudinal flexion of the sole 301, can advantageously have rough surfaces 314 to improve adhesion to the sole. As with the other embodiments previously described, the object is to carry over to a large surface the stresses coming from the connecting means and through this positive relationship "pressing force/pressed surface" make the stresses applied to a sole 101, 201, 301 acceptable, which sole is made of a material necessarily having a low modulus for its walking qualities.

The invention is not limited to the embodiments described by way of example. It covers all equivalent embodiments for solving the problem addressed.

Thus, the connecting means could be other than a round wire or rod.

The connecting means/anchoring means assembly could, in addition to the described latching or molding, be of the crimping or welding type, etc.

Finally, the anchoring means itself could be composed of a plurality of parts with extensions in directions not specified herein to obtain additional effects or functions with respect to the behavior of the sole of the sport boot.

It is also noted that the vertical and horizontal directions previously indicated extend with respect to the longitudinal axis or plane of the boot that is supposedly horizontal.

Moreover, the present invention is not limited to a cross-country application, and it applies to all the soles for sport boots for which similar or identical problems must be solved.

It can especially be applied to snowboard boots or in-line skate boots adapted to be attached removably to their associated sport apparatus.

The instant application is based upon French priority patent applications No. 98 07541, filed Jun. 6, 1998, and No. 97 13748, filed Oct. 29, 1997, the dislosures of which are hereby incorporated by reference thereto in their entireties, and the priorities of which are hereby claimed under 35 USC 119.

What is claimed is:

1. A sole for a sport boot comprising:

a sole extending along a longitudinal axis, said sole including a longitudinally extending downwardly open central groove;

at least one connecting member transversely elongated relative to said longitudinal axis, each of said at least one connecting member extending from a portion of said sole substantially transversely with respect to said longitudinal axis across said central groove, said connecting member being accessible for releasable connection to a sport article; and at least one anchoring member positioned in said sole, securing a respective one of said at least one connecting member to said sole, said at least one anchoring member extending essentially vertically, as the sole is supported on a horizontal surface, from said at least one connecting member along a plane essentially perpendicular to said longitudinal axis of said sole.

2. A sole for a sport boot according to claim 1, wherein:

said at least one anchoring member extends upwardly from said at least one connecting member along said plane essentially perpendicular to said longitudinal axis of said sole.

3. A sole for a sport boot according to claim 1, wherein:

said at least one anchoring member is distinct and non-unitary with respect to said at least one connecting member.

4. A sole for a sport boot according to claim 3, wherein:

said at least one anchoring member extends upwardly from said at least one connecting member along said plane essentially perpendicular to said longitudinal axis of said sole.

5. A sole for a sport boot according to claim 1, wherein:

said sole has a bottom surface; and said at least one anchoring member extends in an essentially perpendicular direction, said direction intersecting said bottom surface of said sole.

6. A sole for a sport boot according to claim 1, further comprising:

upper surface, a bottom surface, and a neutral fiber extending longitudinally between said upper and bottom surfaces; and said at least one anchoring member has a component extending generally horizontally at or above said neutral fiber.

7. A sole for a sport boot according to claim 1, wherein:

said at least one anchoring member extends essentially along a vertical plane.

8. A sole for a sport boot according to claim 1, wherein:

said at least one connecting member comprises at least two longitudinally spaced apart connecting members; and said at least one anchoring member comprises at least two anchoring members, each of said at least two anchoring members being independently secured to said sole.

9. A sole for a sport boot according to claim 1, wherein:

each of said at least one connecting member defines an articulation axle about which said sole is adapted to articulate upon said connection to said sport article.

10. A sole for a sport boot according to claim 9, wherein:

each of said at least one connecting member is a transverse arm of a U-shaped buckle, said U-shaped buckle further having a pair of substantially vertically extending lateral arms, each of said pair of substantially vertically extending lateral arms being constituted by a respective one of said at least one anchoring member and being anchored within said sole.

11. A sole for a sport boot according to claim 10, wherein:

said lateral arms and said transverse arm of each of said at least one connecting member are unitary; and each of said lateral arms of each said connecting member comprises an end portion bent along a direction substantially horizontal and parallel to said transverse arm.

12. A sole for a sport boot according to claim 10, wherein:

for each of said at least one connecting member, said transverse arm extends along a first transverse axis and each of said lateral arms extend along a second transverse axis, said first and second transverse axes being contained in a common substantially vertical plane.

13. A sole for a sport boot according to claim 11, wherein:

for each of said at least one connecting member, said transverse arm extends along a transverse axis and each of said lateral arms extend in a first substantially vertical plane, said transverse axis of said lateral arms is contained in a second substantially vertical plane offset longitudinally with respect to said first substantially vertical plane.

14. A sole for a sport boot according to claim 1, further comprising:

at least one substantially transverse flexion slot is associated with each of said at least one connecting member.

15. A sole for a sport boot according to claim 14, wherein:

at least one of said flexion slot(s) extends along a direction substantially parallel to a metatarsophalangeal articulation of said sole.

16. A sole for a sport boot according to claim 1, wherein:

said central groove is laterally bordered by two flanges; and each of said two flanges has at least one of said anchoring members embedded therein.

17. A sole for a sport boot according to claim 16, wherein:

each of said at least one flexion slot extends over an entirety of a width of each said flange.

18. A sole for a sport boot according to claim 1, wherein:

said at least one connecting member comprises two connecting members, one of said two connecting members being positioned in an area corresponding to a metatarsophalangeal articulation zone.

19. A sole for a sport boot according to claim 1, wherein:

said at least one connecting member comprises two connecting members, each of said two connecting members being positioned forward of an area corresponding to a metatarsophalangeal articulation zone.

20. A sole for a sport boot according to claim 1, wherein:

each of said at least one anchoring member has a vertical height and a longitudinally extending width, said height being greater than said width.

21. A sole for a sport boot according to claim 20, further comprising:

an upper surface, a bottom surface, and a neutral fiber extending longitudinally between said upper and bottom surfaces;

each of said at least one anchoring member further includes a substantially vertically extending portion and at least one substantially horizontally extending portion, every of said at least one substantially horizontally extending portion being positioned above said neutral fiber.

22. A sole for a sport boot according to claim 1, wherein:

each of said at least one connecting member is rearward of a front end of said sole.

23. A sport boot comprising a sole according to claim 1.

24. A sole for a sport boot comprising:

a sole extending along a longitudinal axis, said sole including a downwardly open recessed area and an upper surface;

at least one connecting member transversely elongated relative to said longitudinal axis and extending from a portion of said sole substantially transversely with respect to said longitudinal axis across said downwardly open recessed area, said connecting member being accessible for releasable connection to a sport article; and at least one anchoring member positioned in said sole, securing a respective one of said at least one connecting member to said sole, said at least one anchoring member extending from said at least one connecting member along a plane essentially perpendicular to said longitudinal axis of said sole; and said at least one anchoring member extending in an essentially perpendicular direction, said direction intersecting said upper surface of said sole.

25. A sole for a sport boot comprising:

a sole extending along a longitudinal vertical median plane, said sole including a longitudinally extending downwardly open central groove;

at least one connecting member transversely elongated relative to said longitudinal vertical median plane, each of said at least one connecting member extending from a portion of said sole substantially transversely with respect to said longitudinal vertical median plane across said central groove, said connecting member being accessible for releasable connection to a sport article; and means embedded in said sole for anchoring a respective one of said at least one connecting member to said sole, said means comprising at least one structural member extending from said at least one connecting member along a vertical plane essentially perpendicular to said longitudinal vertical median plane.

26. A sole for a sport boot according to claim 25, wherein:

said at least one structural member extends upwardly from said at least one connecting member along said plane essentially perpendicular to said longitudinal vertical median plane of said sole.

27. A sole for a sport boot according to claim 25, wherein:

said at least one structural member is distinct and non-unitary with respect to said at least one connecting member.

28. A sole for a sport boot according to claim 27, wherein:

said at least one structural member extends upwardly from said at least one connecting member along said plane essentially perpendicular to said longitudinal vertical median plane of said sole.

29. A sole for a sport boot according to claim 25, wherein:

said sole has a bottom surface; and said at least one structural member extends in an essentially perpendicular direction, said direction intersecting said bottom surface of said sole.

30. A sole for a sport boot according to claim 25, further comprising:

upper surface, a bottom surface, and a neutral fiber extending longitudinally between said upper and bottom surfaces; and said at least one structural member has a component extending generally horizontally at or above said neutral fiber.

31. A sole for a sport boot according to claim 25, wherein:

each of said at least one structural member has a vertical height and a longitudinally extending width, said height being greater than said width.

32. A sport boot comprising a sole according to claim 25.

33. A sole for a sport boot comprising:

a sole extending along a longitudinal vertical median plane, said sole including a downwardly open recessed area and an upper surface;

at least one connecting member transversely elongated relative to said longitudinal vertical median plane and extending from a portion of said sole substantially transversely with respect to said longitudinal vertical median plane across said downwardly open recessed area, said connecting member being accessible for releasable connection to a sport article; and means embedded in said sole for anchoring a respective one of said at least one connecting member to said sole, said means comprising at least one structural member extending from said at least one connecting member along a vertical plane essentially perpendicular to said longitudinal vertical median plane; and said at least one structural member extending in an essentially perpendicular direction, said direction intersecting said upper surface of said sole.

* * * * *